US006213105B1

(12) United States Patent
Banzhaf et al.

(10) Patent No.: US 6,213,105 B1
(45) Date of Patent: Apr. 10, 2001

(54) DEVICE FOR EXHAUST RECYCLING FOR AN INTERNAL COMBUSTION ENGINE AND METHOD OF MAKING SAME

(75) Inventors: Matthias Banzhaf, Heilbronn; Martin Bauer, Marbach; Osman Sari, Grevenbroich; Gérard Dietz, Rommerskirchen; Helmut Blank, Bornheim, all of (DE)

(73) Assignees: Behr GmbH & Co., Stuttgart; Pierburg AG, Neuss, both of (DE)

( * ) Notice: Subject to any disclaimer, the term of this patent is extended or adjusted under 35 U.S.C. 154(b) by 0 days.

(21) Appl. No.: 09/192,588

(22) Filed: Nov. 17, 1998

(30) Foreign Application Priority Data

Nov. 17, 1997 (DE) ..... 197 50 588

(51) Int. Cl.[7] ..... F02M 25/07
(52) U.S. Cl. ..... 123/568.12
(58) Field of Search ..... 123/568.11, 568.12; 60/605.2

(56) References Cited

U.S. PATENT DOCUMENTS

| | | | | |
|---|---|---|---|---|
| 2,408,846 | * | 10/1946 | Golden et al. | 123/568.12 |
| 3,621,825 | * | 11/1971 | Ojala | 123/568.12 |
| 4,134,377 | * | 1/1979 | Bamsey et al. | 123/568.12 |
| 4,163,282 | * | 7/1979 | Yamada et al. | 123/568.12 |
| 5,617,726 | * | 4/1997 | Sheridan et al. | 123/568.12 |
| 5,690,081 | * | 11/1997 | Kwiatkowski | 123/568.12 |
| 5,732,688 | * | 3/1998 | Charlton et al. | 123/568.12 |
| 5,931,131 | * | 8/1999 | Hackett | 123/568.12 |
| 5,970,960 | * | 10/1999 | Azuma | 123/568.12 |

FOREIGN PATENT DOCUMENTS

| | | |
|---|---|---|
| PS914450 | 5/1954 | (DE) . |
| 4325169C1 | 9/1994 | (DE) . |
| 4414429C1 | 6/1995 | (DE) . |
| 9421145 U | 6/1995 | (DE) . |
| 4424644C1 | 11/1995 | (DE) . |
| 19521573A1 | 12/1996 | (DE) . |
| 19541362C1 | 1/1997 | (DE) . |
| Search Report | 8/1998 | (DE) . |
| 2301177A | 11/1996 | (GB) . |
| WO97/33078 | 9/1997 | (WO) . |

OTHER PUBLICATIONS

ATZ Automobiltechnische Zeitschrift, vol. 99 (1997), No. 9 (R. Lutz: "Lowering Diesel Emissions by Recycling Cooled Exhaust; Sep. 1999".

* cited by examiner

*Primary Examiner*—Willis R. Wolfe
(74) *Attorney, Agent, or Firm*—Evenson, McKeown, Edwards & Lenahan, P.L.L.C.

(57) ABSTRACT

A device for exhaust recycling for an internal combustion engine with an exhaust cooler has a valve that determines the quantity of exhaust that is recycled and is adjustable by an adjusting element. Provision is made for the exhaust cooler and the valve to connect to one another directly and to form a module.

50 Claims, 4 Drawing Sheets

DEVICE FOR EXHAUST RECYCLING FOR AN INTERNAL COMBUSTION ENGINE AND METHOD OF MAKING SAME

BACKGROUND AND SUMMARY OF THE INVENTION

This application claims the priority of German application 197 50 588.0, filed in Germany on Nov. 17, 1997, the disclosure of which is expressly incorporated by reference herein.

The invention relates to a device for exhaust recycling for an internal combustion engine with an exhaust cooler and with a valve that determines the quantity of recycled exhaust, controllable by an adjusting element.

Recycling of cooled exhaust to an internal combustion engine, especially for lowering diesel emissions, is known from ATZ Automobiltechnische Zeitschrift, Vol. 99 (1997), No. 9 (R. Lutz: "Lowering Diesel Emissions by Recycling Cooled Exhaust"). The exhaust recycling valve (AGR valve) and the exhaust cooler (exhaust heat-transfer device) are parts that are independent of one another, installed at different points in the vehicle, and connected with one another by an exhaust line.

A goal of the invention is to modify a device of the type recited at the outset so that a simplified method of manufacturing is obtained.

This goal is achieved by connecting the exhaust cooler and valve directly together so that they form a module. As a result, a simplified and hence less expensive method of manufacture can be performed since individual previously provided elements can be eliminated. In particular, the gas line between the valve and the exhaust cooler is eliminated, together with the connections required therefor.

In preferred embodiments of the invention, provision is made for the adjusting element to be mounted on a part that is in a heat-conducting relationship with the exhaust cooler. This has the advantage that a cooling effect is exerted on the adjusting element by the exhaust cooler, so that the adjusting element is subjected to less heat stress.

In another embodiment of the invention, provision is made such that the adjusting element is mounted on a part provided with one or more channels for a liquid coolant. This produces the advantage that the valve and especially its adjusting element are cooled actively.

Both embodiments allow the valve to be mounted on the exhaust supply side of the exhaust cooler. Mounting the valve on the supply side of the exhaust cooler, i.e. on the side at which the hot exhaust enters, has the advantage that there is a relatively small danger of residues from the exhaust adhering to the valve and its valve elements. This danger, which is even greater when the valve is located downstream from the exhaust cooler, means that adjusting elements with relatively high adjusting forces must be provided which can reliably overcome any jamming of the valve elements caused by deposits of exhaust residues. When it is mounted on the exhaust supply side, the danger of deposits composed of exhaust residues is much less. On the other hand, there is still the danger with this arrangement that the adjusting elements, especially electrical adjusting elements, will be subjected to excessive heat stress. This thermal overloading is offset by the fact that the adjusting element is mounted on a part whose temperature is significantly less than the temperature of the exhaust coming from the internal combustion engine.

In certain preferred embodiments of the invention, provision is made such that the channel or channels of the part that supports the positioning element is/are connected to a coolant supply to the exhaust cooler. Further simplification can be achieved in this manner, since no external connecting lines need be provided between the channels that serve for cooling of the part that supports the positioning element and the exhaust cooler.

In certain preferred embodiments of the invention, provision is made such that the exhaust cooler has an elongate form and that the adjusting element is arranged essentially parallel next to the exhaust cooler. This results in a compact design that can be accommodated relatively simply in a vehicle.

Other objects, advantages and novel features of the present invention will become apparent from the following detailed description of the invention when considered in conjunction with the accompanying drawings.

DETAILED DESCRIPTION OF THE DRAWINGS

Figure 1:
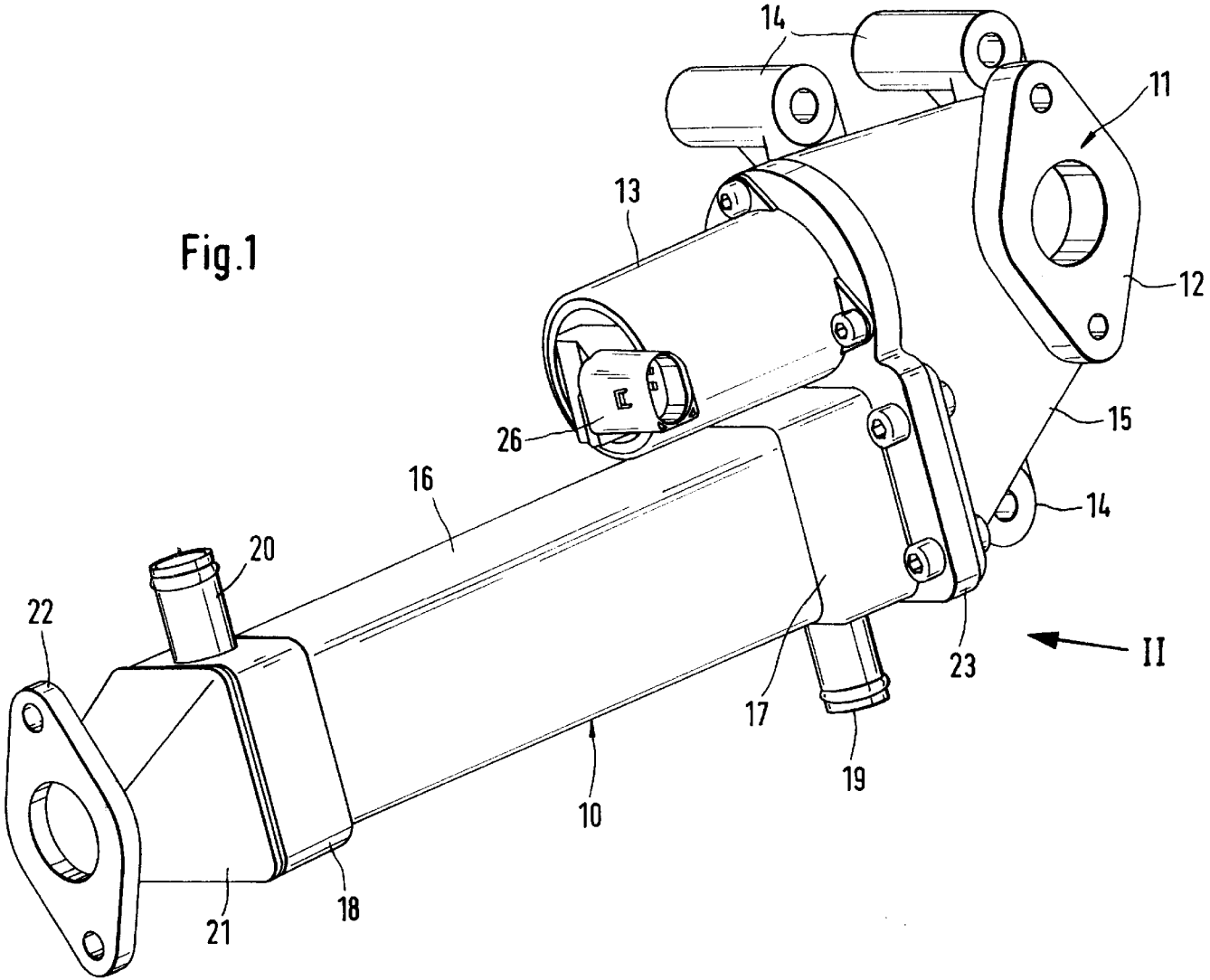
FIG. 1 is a perspective view of a module composed of an exhaust cooler and a valve that determines the volume of exhaust flowing through, constructed according to a preferred embodiment of the present invention.
Figure 2:
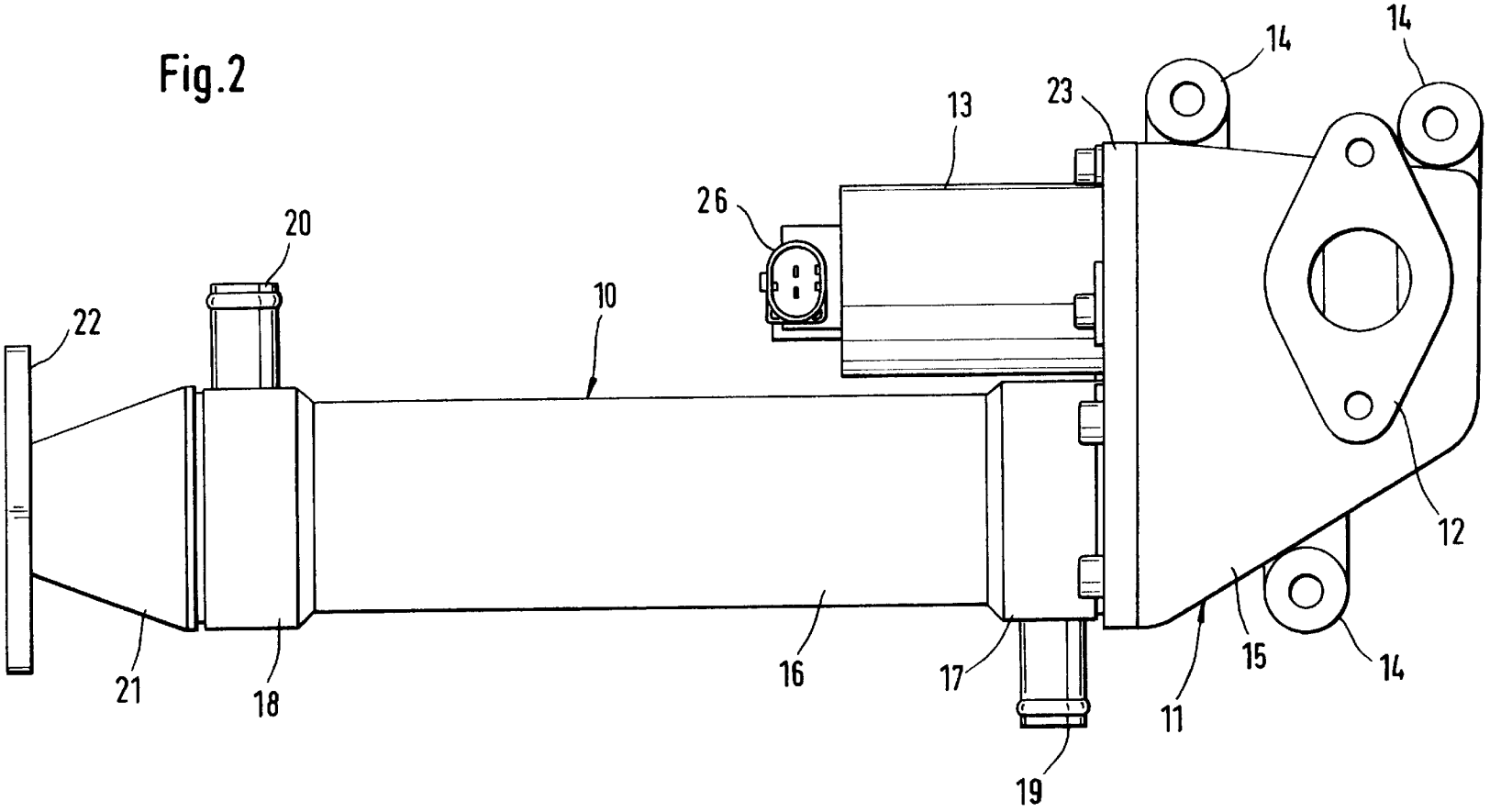
FIG. 2 is a view taken in the direction of arrow II in FIG. 1.

The module shown in FIGS. 1 and 2 comprises an exhaust cooler 10 and a valve 11, a so-called AGR valve. Valve 11 and exhaust cooler 10 are preferably arranged as shown in FIG. 2 of the reference cited at the outset, i.e. valve 11 is located on the exhaust supply side of exhaust cooler 10.

Valve 11 is provided with a connecting flange 12 by which it can be connected to an exhaust line coming from an internal combustion engine. Inside the valve housing, in a manner not shown in greater detail, an adjustable valve element is provided that is associated with a valve seat. The valve determines the quantity of exhaust that flows into exhaust cooler 10. The valve element is adjusted by means of an adjusting element 13, especially an electromagnetic adjusting element. Depending on the engine data specified, valve 11 determines the quantity of exhaust to be mixed with fresh air supplied to the internal combustion engine. Adjusting element 13 can operate so that it performs two-point regulation or cross-section regulation. Valve 11 is provided with fastening means 14 enabling it to be fastened to a mount, for examine the engine block of the internal combustion engine. Valve 11 has a distribution chamber 15 that expands funnelwise, by means of which the exhaust is supplied to exhaust cooler 10.

Exhaust cooler 10 is designed in principle in the same way as is known from the reference mentioned at the outset (ATZ Automobiltechnische Zeitschrift, Vol. 99 (1997), No. 9). At each of its ends, it has a bottom into which the ends of a plurality of rectangular tubes are inserted, said ends being located at a distance from one another. The tube bundle made of rectangular tubes is surrounded by a jacket 16 that forms reversing chambers 17, 18 at the two end areas. Chambers 17, 18 are provided with connections 19, 20 through which the coolant is supplied to the engine cooling circuit and removed therefrom. Preferably the coolant flows parallel to the exhaust in exhaust cooler 10 so that connection 19 is a supply connection and connection 20 is a recycling connection.

A collecting chamber 21 that tapers roughly in the shape of a funnel abuts the bottom that closes off chamber 18 and receives the ends of the tube bundle, said chamber making a transition to a flange 22 connected with an exhaust line that leads further.

The end of exhaust cooler 10 that faces valve 11 is provided with a flange 23 which preferably also forms the bottom for the tube bundle of the exhaust cooler. The housing of valve 11 is flanged to this flange 23. Adjusting element 13 is fastened to flange 23 next to exhaust cooler 10, said element being aligned essentially parallel to jacket 16 of the exhaust cooler. Flange 23 is made with relatively thick walls so that it forms a thermal barrier between the housing of valve 11 and adjusting element 13. Flange 23, which is also cooled by the coolant flowing through exhaust cooler 10, has a much lower temperature than the valve housing of valve 11, so that adjusting element 13 is isolated thermally from valve 11 and accordingly is subjected only to a relatively low heat stress.

Figure 3:
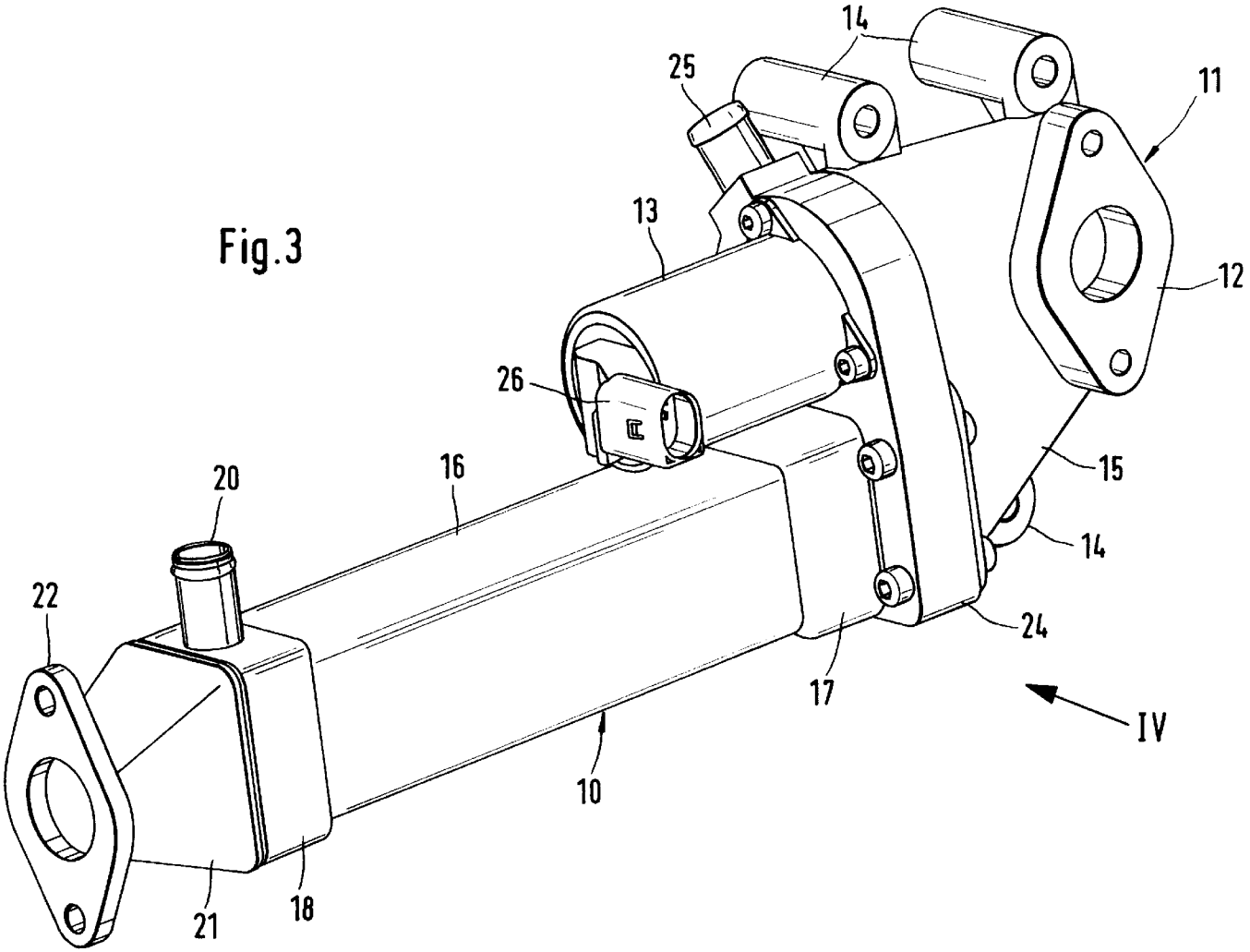
FIG. 3 is a perspective view of a module composed of an exhaust cooler and a valve with active cooling of an adjusting element that belongs to the valve, constructed according to another embodiment of the present invention.
Figure 4:
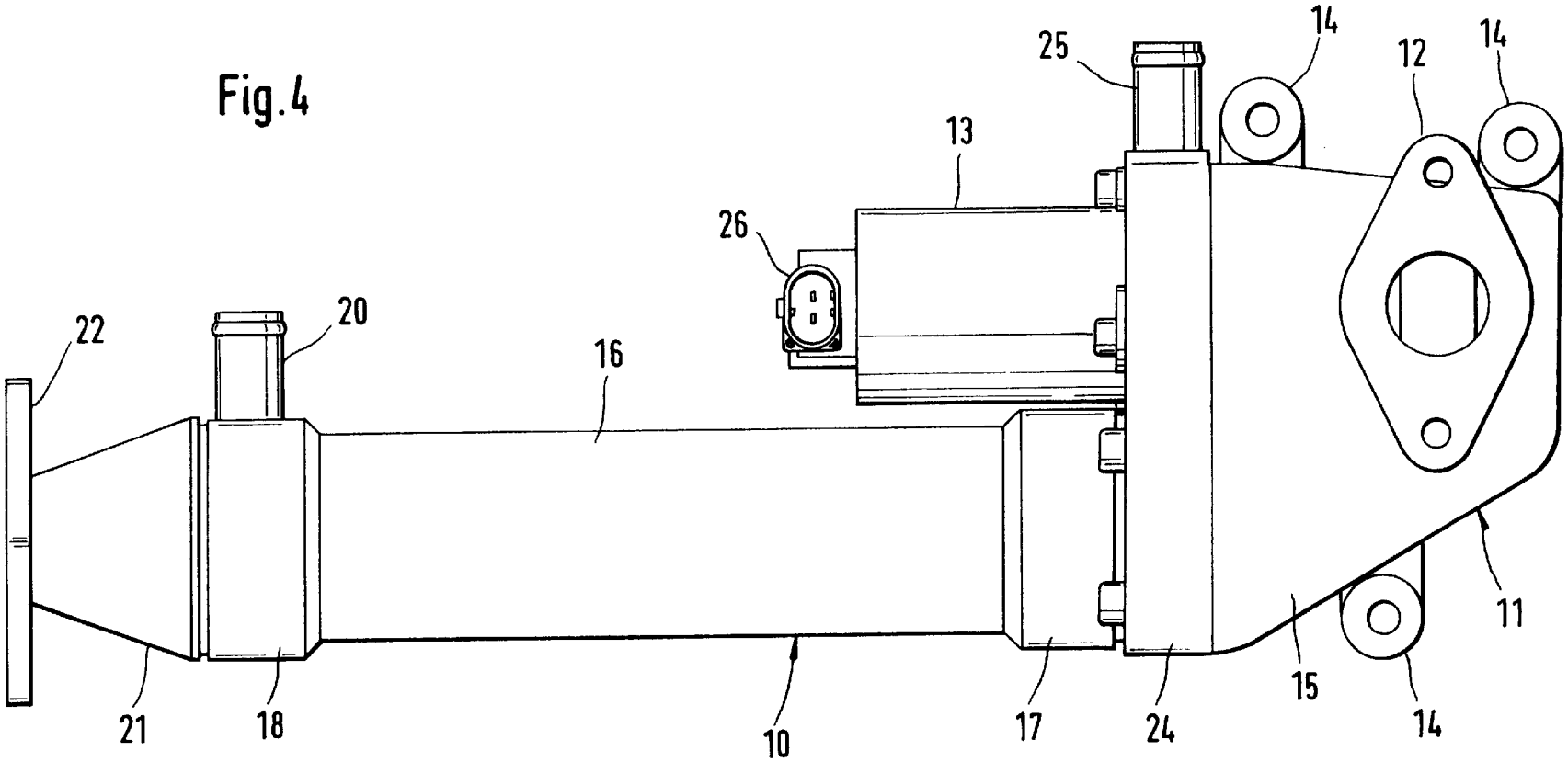
FIG. 4 is a view taken in the direction of arrow IV in FIG. 3.

The module of the embodiment in FIGS. 3 and 4, likewise composed of an exhaust cooler 10 and a valve 11, corresponds in theoretical design and theoretical arrangement to the embodiment in FIGS. 1 and 2. Unless otherwise explained, the similarly numbered parts of the embodiment of FIGS. 3 and 4 operate as described for the FIGS. 1 and 2 embodiment. Exhaust cooler 10 however is provided with a thicker flange 24 (as compared to flange 23 of FIGS. 1 and 2) that is provided in a manner not shown in greater detail with channels that lead from a supply connection 25 to chamber 17 of jacket 16, through which channels the coolant of the internal combustion engine is guided to chamber 17 of exhaust cooler 10. Flange 24 is therefore cooled actively, so that even better thermal isolation is obtained between valve 11 and adjusting element 13.

In the embodiments according to FIGS. 1, 2 and 3, 4, an electromagnetic adjusting element 13 is provided in each case, said element being equipped with a connecting plug 26 for the power supply. In modified embodiments, other adjusting elements are provided, for example pneumatic adjusting elements that perform the same function. These adjusting elements are likewise then isolated thermally to a significant degree from the valve so that they are exposed to only a relatively low temperature stress.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method of making an exhaust recycling system for an internal combustion engine, comprising:

providing an exhaust cooler, providing a valve that determines the quantity of gas recycled and is adjustable by an adjustable element, directly adjoining the exhaust cooler and the valve to form a module, flangedly connecting the exhaust cooler and the valve together, and mounting the adjusting element on a flange of the exhaust cooler.

2. Method according to claim 1, wherein the electrically operable adjusting element is positioned laterally of the exhaust cooler away from flow of exhaust gases through the exhaust cooler.

3. A method of making an exhaust recycling system for an internal combustion engine, comprising:

providing an exhaust cooler, providing a valve that determines the quantity of gas recycled and is adjustable by an adjustable element, directly adjoining the exhaust cooler and the valve to form a module, mounting the adjusting element on a part that is provided with at least one channel for liquid coolant, and providing the valve housing of the valve with fastening devices for fastening the module to a mount.

4. Method according to claim 3, wherein the electrically operable adjusting element is positioned laterally of the exhaust cooler away from flow of exhaust gases through the exhaust cooler.

5. A method of making an exhaust recycling system for an internal combustion engine, comprising:

providing an exhaust cooler, providing a valve that determines the quantity of gas recycled and is adjustable by an electrically operable adjustable element, directly adjoining the exhaust cooler and the valve to form a module, and mounting the adjusting element on a part in contact with liquid coolant flowing through the exhaust cooler.

6. A method according to claim 5, wherein the valve is mounted on an exhaust supply side of the exhaust cooler.

7. Method according to claim 5, wherein the electrically operable adjusting element is positioned laterally of the exhaust cooler away from flow of exhaust gases through the exhaust cooler.

8. Device for exhaust recycling for an internal combustion engine with an exhaust cooler and with a valve that determines the quantity of gas recycled and is adjustable by an electrically operable adjusting element, wherein the exhaust cooler and the valve directly adjoin one another and form a module, and wherein the adjusting element is mounted on a part in contact with liquid coolant flowing through the exhaust cooler.

9. Device according to claim 8, wherein a valve housing of the valve is provided with fastening devices for fastening the module to a mount.

10. Device according to claim 1, wherein the electrically operable adjusting element is positioned laterally of the exhaust cooler away from flow of exhaust gases through the exhaust cooler.

11. Device according to claim 8, wherein the exhaust cooler and the valve are flanged to one another and the adjusting element is mounted on a flange of the exhaust cooler.

12. Device according to claim 11, wherein the flange of the exhaust cooler on which the adjusting element is mounted is disposed on an exhaust supply side of the exhaust cooler.

13. Device according to claim 8, wherein the exhaust cooler has an elongate shape and the adjusting element is located essentially parallel next to the exhaust cooler.

14. Device according to claim 13, wherein the exhaust cooler and the valve are flanged to one another and the adjusting element is mounted on a flange of the exhaust cooler.

15. Device according to claim 13, wherein a valve housing of the valve is provided with fastening devices for fastening the module to a mount.

16. Device according to claim 8, wherein the part in contact with liquid coolant includes at least one channel which connects to a coolant supply to the exhaust cooler.

17. Device according to claim 16, wherein the exhaust cooler has an elongate shape and the adjusting element is located essentially parallel next to the exhaust cooler.

18. Device according to claim 16, wherein the exhaust cooler and the valve are flanged to one another and the adjusting element is mounted on a flange of the exhaust cooler.

19. Device according to claim 16, wherein a valve housing of the valve is provided with fastening devices for fastening the module to a mount.

20. Device according to claim 8, wherein the valve is mounted on an exhaust supply side of the exhaust cooler.

21. Device according to claim 20, wherein the part in contact with liquid coolant includes at least one channel which connects to a coolant supply to the exhaust cooler.

22. Device according to claim 20, wherein the exhaust cooler has an elongate shape and the adjusting element is located essentially parallel next to the exhaust cooler.

23. Device according to claim 20, wherein the exhaust cooler and the valve are flanged to one another and the adjusting element is mounted on a flange of the exhaust cooler.

24. Device according to claim 20, wherein a valve housing of the valve is provided with fastening devices for fastening the module to a mount.

25. A method of making an exhaust recycling system for an internal combustion engine, comprising:

providing an exhaust cooler, providing a valve that determines the quantity of gas recycled and is adjustable by an adjustable element, and directly adjoining the exhaust cooler and the valve to form a module, wherein the adjusting element is boltably mounted on a flange part that is provided with at least one channel for liquid coolant.

26. A method according to claim 25, wherein the at least one channel for liquid coolant connects to a coolant supply to the exhaust cooler.

27. A method according to claim 25, wherein the exhaust cooler has an elongate shape and the adjusting element is located essentially parallel next to the exhaust cooler.

28. A method according to claim 25, comprising mounting the valve on a side of the flange part provided with at least one channel for liquid coolant, which side faces away from the exhaust cooler.

29. Method according to claim 25, wherein the electrically operable adjusting element is positioned laterally of the exhaust cooler away from flow of exhaust gases through the exhaust cooler.

30. A method according to claim 25, wherein the valve is mounted on an exhaust supply side of exhaust cooler.

31. A method according to claim 30, wherein the exhaust cooler has an elongate shape and the adjusting element is located essentially parallel next to the exhaust cooler.

32. Device for exhaust recycling for an internal combustion engine with an exhaust cooler and with a valve that determines the quantity of gas recycled and is adjustable by an adjusting element, wherein the exhaust cooler and the valve directly adjoin one another and form a module, and wherein the exhaust cooler and the valve are flanged to one another and the adjusting element is mounted on a flange of the exhaust cooler.

33. Device according to claim 32, wherein the flange of the exhaust cooler includes at least one channel for liquid coolant.

34. Device according to claim 32, wherein the flange of the exhaust cooler on which the adjusting element is mounted is disposed on an exhaust supply side of the exhaust cooler.

35. Device according to claim 32, wherein the electrically operable adjusting element is positioned laterally of the exhaust cooler away from flow of exhaust gases through the exhaust cooler.

36. Device according to claim 32, wherein the exhaust cooler has an elongate shape and the adjusting element is located essentially parallel next to the exhaust cooler.

37. Device according to claim 36, wherein the flange of the exhaust cooler includes at least one channel for liquid coolant.

38. Device according to claim 32, wherein a valve housing of the valve is provided with fastening devices for fastening the module to a mount.

39. Device according to claim 38, wherein the flange of the exhaust cooler includes at least one channel for liquid coolant.

40. Device according to claim 32, wherein the valve is mounted on an exhaust supply side of the exhaust cooler.

41. Device according to claim 40, wherein the flange of the exhaust cooler includes at least one channel for liquid coolant.

42. Device according to claim 40, wherein the exhaust cooler has an elongate shape and the adjusting element is located essentially parallel next to the exhaust cooler.

43. Device according to claim 42, wherein the flange of the exhaust cooler includes at least one channel for liquid coolant.

44. Device for exhaust recycling for an internal combustion engine with an exhaust cooler and with a valve that determines the quantity of gas recycled and is adjustable by an adjusting element, wherein the exhaust cooler and the valve directly adjoin one another and form a module, wherein the adjusting element is mounted on a part that is provided with at least one channel for liquid coolant, and wherein a valve housing of the valve is provided with fastening devices for fastening the module to a mount.

45. Device according to claim 44, wherein the part with the at least one channel supports the adjusting element and the at least one channel connects to a coolant supply to the exhaust cooler.

46. Device according to claim 44, wherein the exhaust cooler has an elongate shape and the adjusting element is located essentially parallel next to the exhaust cooler.

47. Device according to claim 44, wherein the electrically operable adjusting element is positioned laterally of the exhaust cooler away from flow of exhaust gases through the exhaust cooler.

48. Device according to claim 44, wherein the valve is mounted on an exhaust supply side of exhaust cooler.

49. Device according to claim 48, wherein the part with the at least one channel supports the adjusting element and the at least one channel connects to a coolant supply to the exhaust cooler.

50. Device according to claim 48, wherein the exhaust cooler has an elongate shape and the adjusting element is located essentially parallel next to the exhaust cooler.

* * * * *